United States Patent [19]

Queille

[11] Patent Number: 4,744,839

[45] Date of Patent: May 17, 1988

[54] PROCESS FOR A RAPID AND HOMOGENEOUS CARBURIZATION OF A CHARGE IN A FURNACE

[75] Inventor: Philippe Queille, Viroflay, France

[73] Assignee: L'Air Liquide, Paris, France

[21] Appl. No.: 885,852

[22] Filed: Jul. 15, 1986

[30] Foreign Application Priority Data

Aug. 14, 1985 [FR] France ..... 85 12379

[51] Int. Cl.[4] ..... C21D 1/74

[52] U.S. Cl. ..... 148/16.5; 148/16.6

[58] Field of Search ..... 148/16, 16.5, 16.6, 148/20.3

[56] References Cited

U.S. PATENT DOCUMENTS

| | | | |
|---|---|---|---|
| Re. 26,935 | 8/1970 | Cullen | 148/16 |
| 2,955,062 | 10/1960 | Cullen | 148/16 |
| 3,950,192 | 4/1976 | Golland et al. | 148/16 |
| 4,049,472 | 9/1977 | Arndt | 148/16 |
| 4,145,232 | 3/1979 | Solomon | 148/16 |
| 4,175,986 | 11/1979 | Ewalt et al. | 148/16 |
| 4,201,600 | 5/1980 | Luiten et al. | 148/16 |
| 4,306,918 | 12/1981 | Kaspersma et al. | 148/16 |
| 4,519,853 | 5/1985 | Kostelitz et al. | 148/16 |

FOREIGN PATENT DOCUMENTS

| | | |
|---|---|---|
| 0096602 | 9/1983 | European Pat. Off. . |
| 2249179 | 10/1974 | France . |
| 2404051 | 9/1978 | France . |

OTHER PUBLICATIONS

J. Pavlossoglou, "Optimisation Model of a Two Stage Boost/Diffusion Treatment–Two Stage Gas Carburizing Control", 4/76.

N. Koebel, "Application of Instrumentation to Achieve Precision Carburizing", vol. 1, #2–23, 1979, American Society for Metals.

C. H. Luiten & W. Goehring, "Direct Atmosphere Generation and Control in Heat Treatment Furnaces", 5–80.

J. Taylor, "The Diffusion of Carbon and the Carburization Process", 3/50, Journal of the Iron & Steel Institute.

ASM Committee on Gas Carburizing, "Gas Carburizing", 1964 American Society for Metals.

S. Jansen, "Productivity Increase in Pusher Furnaces Using UCAR Protective Atmospheres from Nitrogen and Methanol".

N. M. Buslovich, "Laws Governing the Interaction of the Gaseous Medium with the Surface of the Metal".

ASM Committee on Furnace Atmospheres, "Furnace Atmospheres and Carbon Control", Metals Handbook, 1964.

*Primary Examiner*—Christopher W. Brody

[57] ABSTRACT

The process comprises opening the door of the furnace, introducing a charge into the furnace which was previously conditioned at the carburization temperature, closing the door of the furnace, subjecting the charge to a first phase, termed carburization phase, in the course of which the rate of transfer of the carbon of the atmosphere to the surface of the workpiece is preponderant relative to the rate of diffusion of the carbon from the surface of the workpiece to the interior of the workpiece, then to a second phase, termed diffusion phase, in the course of which said rate of diffusion becomes preponderant relative to said rate of transfer, the charge being possibly cooled before the opening of the door of the furnace so as to permit its extraction and the introduction of a new charge, a carrier gas, to which hydrocarbon may be added, being introduced into the furnace throughout the duration of the process. According to the invention, the flow rate $D_1$ of carrier gas during the carburization phase is related to the flow rate $D_2$ of carrier gas during the diffusion phase by the relation $$1.2\ D_2 \leqq D_1 \leqq 2 \times D_2,$$

the flow rate $D_2$ being higher than or equal to the minimum safety limit of the considered furnace.

9 Claims, 1 Drawing Sheet

PROCESS FOR A RAPID AND HOMOGENEOUS CARBURIZATION OF A CHARGE IN A FURNACE

The present invention relates to a carburization-diffusion process in a charge furnace, comprising opening the door of the furnace, introducing a charge into the furnace which is previously-conditioned at the carburization temperature, closing the door of the furnace, subjecting the charge to a first phase, termed carburization phase, in the course of which the rate of transfer of the carbon of the atmosphere to the surface of the workpiece is preponderant relative to the rate of diffusion of the carbon from the surface of the workpiece to the interior of the latter, then to a second phase, termed diffusion phase, in the course of which said rate of diffusion becomes preponderant relative to said rate of transfer, it being possible to allow the temperature of the furnace to decrease in the course of said second phase, the charge being possibly cooled before the opening of the door so as to permit its extraction and the introduction of a new charge, a carrier gas, to which a hydrocarbon may be added, being introduced into the furnace throughout the duration of the process.

A charge furnace comprises an entrance door for the charge, which is closed throughout the duration of the treatment so as to maintain a controlled atmosphere in the furnace and avoid entry of air.

The atmosphere of a charge furnace in the course of a carburization (see for example U.S. Pat. No. 4,145,232) usually comprises the following components:

CO: 4–30%
$H_2$: 10–60%
$N_2$: 10–85%
$CO_2$: 0–4%
$H_2O$: 0–5%
Hydrocarbon: 0–10%

In order to reduce the cost of the carburizing treatment of a charge of workpieces, one skilled in the art seeks to reduce the flows of gas introduced into the furnace.

In the past, generators, termed endothermic generators, were used for creating the required carburizing atmosphere. The generators using natural gas thus produce an atmosphere containing principally about 20% CO, 40% $H_2$ and 40% $N_2$ at a constant rate of flow.

More recently, endothermic generators have been replaced by the injection of a mixture of methanol and nitrogen so that it is possible to vary the composition of the atmosphere within the aforementioned limits. It is indeed known that the methanol is decomposed, beyond a temperature of 750° C., principally into carbon monoxide and hydrogen according to the reaction:

$$CH_3OH \rightarrow CO + 2H_2.$$

The simple substitution of the generator by sources of gas at a constant rate of flow has permitted a reduction of the latter and a saving while providing a charge of identical quality. One example of a process of this type is disclosed in the U.S. Pat. No. 4,519,853.

At the present time, it is still sought to reduce these flows of gas so as to obtain a still more favorable economic balance.

One skilled in the art knows that the flow of gas cannot be reduced below a minimum limit below which various problems are met.

When the doors of the furnace are closed and if the flow rate of the injected gas is lower than the minimum limit (determined experimentally and depending on the furnace and the treating conditions), this results in entries of air due to the absence of fluid tightness of heat treating furnaces. To compensate for these entries of oxidizing species, one skilled in the art provides an additional injection of hydrocarbons so as to maintain the carbon potential above a desired value. Now, this additional injection of hydrocarbons considerably increases the risk of soot deposition and moreover results in a dilution of the concentrations of carbon monoxide and hydrogen, which is contrary to what is desired, since these concentrations must be maintained as high as possible for a good carburization: it is indeed known (see for example J. Heat Treating -14-Vol. 1 No. 13-"Basic requirements for reducing the consumption of carburizing gases" U. Wss-R. Hoffmann and P. Neumann) that the coefficient of transfer of the carbon of the carburizing atmosphere to the workpiece to be carburized depends on the product $PH_2 \times pCO$ (partial pressures of $H_2$ and CO in the furnace). (See also R. J. Fruchen "The rate of carburization of Iron in CO—$H_2$Atmospheres"-Part. 1-Effect of temperature and CO and $H_2$ pressures-Metallurgical Transactions-vol. 4-Sept. 1972-PP. 2123–2127).

Further, a low gas flow rate in the furnace results in a corresponding longer reconditioning of the latter. When the door of the furnace is opened for introducing the charge, a large quantity of air at ambient temperature is introduced. The atmosphere is thus "deconditioned", the concentration of oxidizing species ($CO_2$, $O_2$, $H_2O$) becoming much too high to enable the carburizing process to proceed correctly. Moreover, the temperature of the furnace, usually between 850° C. and 1050° C., drops owing to the introduction of the charge at ambient temperature. This drop in temperature is accompanied by a passage to a temperature lower than the safety temperature below which the atmosphere becomes explosive. To reduce this risk, hydrogen is injected into the furnace to dilute the atmosphere and remain within the safety standards. This results in a reduction in the concentration of carbon monoxide and hydrogen of the atmosphere. Therefore it is not possible to both maintain the rate flow in the furnace at the minimum limit and maintain a quality identical to that of charges treated at a gas flow rate which is "conventional", i.e. higher than the minimum flow rate (by quality of charge is meant the visual appearance of the surface of the workpiece, the carburized depth obtained for a given period of carburization, and the homogeneity of these two parameters in the charge).

The invention avoids these drawbacks.

It has been found, surprisingly, that, for a given quality of treated workpieces, it was possible to reduce the flow rate of the gases during the diffusion phase. This is surprising, since it has always been considered in the art that the rates of flow of gas must be the same during the carburizing and diffusion phases.

In the process according to the invention, the flow rate D of carrier gas during the carburizing phase is related to the flow rate D of carrier gas during the diffusion phase by the relation $$1.2D_2 \leqq D_1 \leqq 2 \times D_2,$$

the flow rate $D_2$ being higher than or equal to the minimum limit of safety of the furnace used. Preferably, $D_1$ will be higher than or equal to 1.5 $D_2$.

From the opening to the closing of the door of the furnace, i.e. during the introduction of the charge to be carburized in the furnace, several preferential variants are possible. If it is desired to obtain workpieces of excellent quality as rapidly as possible, the gas flow rate will be equal to the value $D_1$. On the other hand, if it is desired to economize as far as possible the gas while slightly prolonging the carburizing cycle, the gas flow rate of will be equal to $D_2$.

Lastly, if it is desired to reduce to the maximum the duration of the carburizing cycles, the gas flow rate will be equal to $D_3 > D_1$ and preferably higher than $1.2D_1$ but lower than $2 \times D_1$. This flow rate $D_3$ may be maintained in the case of an automatic regulation of the gas flows as a function of the temperature, until the return to the temperature T of carburization of the charge introduced.

Generally, the flow rate $D_2$ of carrier gas will be lower than the "conventional" flow rate, the flow rate $D_1$ being higher than or equal to a "conventional" flow rate. By "conventional" flow rate is meant the constant flow rate usually used in the art in the course of a carburization-diffusion for obtaining the same qualities of treated workpieces. The process according to the invention permits reaching a quality of the treated workpieces which is identical to or better than that obtained with the conventional process while it permits a reduction in the consumption of carrier gas. Indeed, in the phase of the high flow rate $D_1$ (carburization) it is found:

- that this high flow rate $D_1$ permits an accelerated heating of the charge by convection;
- that it enables a high carbon potential to be maintained without excessive addition of hydrocarbon. This is important, since the additional hydrocarbons are always partly cracked and soot is produced (uncontrollable reaction outside equilibrium). The less hydrocarbon injected, the less soot deposited in the furnace;
- that the content of CO in the atmosphere, on which depends the rate of transfer of the carbon of the atmosphere to the workpiece, is rapidly increased, which enables the duration of the carburizing cycle to be reduced.

In the course of the diffusion phase, it is generally sufficient to maintain a carbon potential of the atmosphere substantially equal to the desired final concentration of carbon on the surface of the workpiece.

Thus it is possible to reduce the flow rate of the carrier gas in the course of the diffusion phase by a factor of 1.2 to 2 relative to the flow rate in the course of the carburizing phase, so as to render the atmosphere less active, to reduce the mean carbon potential to around 0.6 to 0.8, thus achieving a smaller sweeping of the workpieces and tolerating entries of air within the limits of safety of operation.

The desired atmosphere may therefore be likened to an atmosphere termed a protective atmosphere which is neutral with respect to the surface of the workpieces (neither carburization nor decarburization).

According to another mode of carrying out the invention, it is also possible to vary the composition of the atmosphere according to the teaching of U.S. Pat. No. 4,519,853, and also according to the teaching of U.S. Pat. No. 4,306,918.

However, preferably there will be chosen an atmosphere which is produced from methanol put into the form of a spray with the aid of nitrogen. In the first phase of the process, there is generally used at least 20% nitrogen and the complement methanol. Indeed, it has been found that, for a reliable operation of the process according to the invention, it is quite appropriate to spray the methanol pneumatically, the minimum quantity of nitrogen being then 10% but preferably 20%. In this way, there are avoided serious risks of soot in the furnace for atmospheres containing only methanol, as disclosed in U.S. Pat. No. 4,306,918, and a premature clogging of the injection orifice of the metanol. An injection pipe, such as disclosed in U.S. Pat. No. 4,279,406, is for example suitable for this operation. The use of an atmosphere produced by means of methanol (or any other equivalent alcohol) enables a substantially constant ratio $pCO/pH_2$ to be maintained. In the second phase of the process, there will preferably be employed a mixture comprising about 70% nitrogen and 30% methanol, the flow rate of gas injected into the furnace in the course of the carburizing phase being about 1.5 higher than the flow rate of gas injected in the course of the diffusion phase. However, the dilution of the methanol by the nitrogen in this diffusion phase may rather substantially vary within the limits disclosed in U.S. Pat. No. 4,519,853.

A better understanding of the invention will be had from the following modes which are given as non-limiting examples with reference to the accompanying drawings, in which.

EXAMPLE 1

Figure 1:
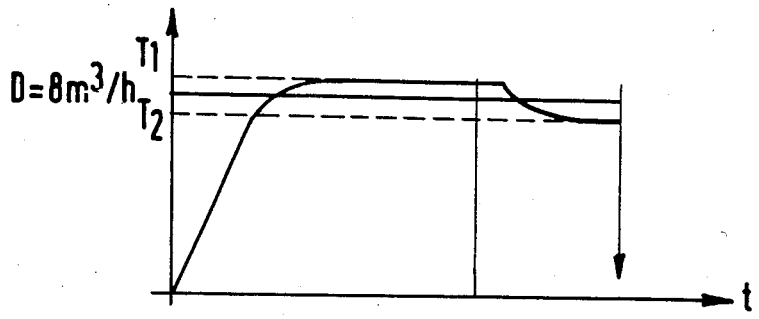
FIGS. 1 and 2 are illustrations of the prior art.

A charge of 350 kg of a workpiece of steel of grade 20 MC5 is introduced into a charging furnace having an incorporated quenching bath. The flow rate of the carrier gas of fixed composition is constant (8 $m^3/h$) throughout the duration of the carburization and diffusion. The carburizing temperature $T_1$ is 920° C., and that of the diffusion rapidly passes to the value $T_2$ 870° C. according to the temperature profile shown in FIG. 1. The results obtained on all of the charge workpieces are the following:

carburized thickness at 550 VH1 = 0.95 to 1.05 mm,
pale grey appearance,
slight residual austenite.

This example represents the known art with a "conventional" flow rate of carrier gas. The quality of the charge is good.

EXAMPLE 2

Figure 2:
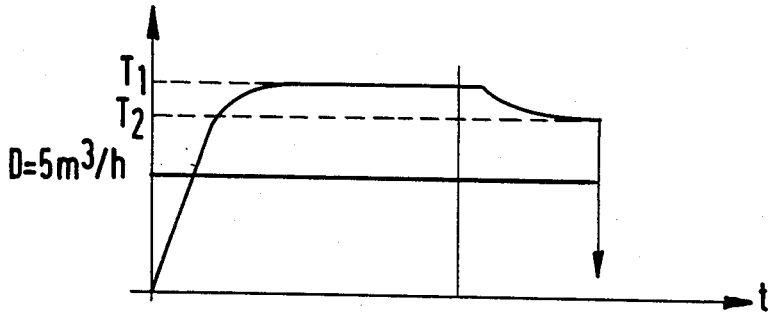

Under the same conditions as before (FIG. 2), but with a low constant flow rate (safety limit) of 5 $m^3/h$ of carrier gas, the following results are obtained.

carburized thickness at 550 VH1 = 0.80 to 1.00 mm,
dark grey appearance,
soot deposit in parts.

The quality of the charge is mediocre: the carburized thickness obtained has decreased for identical durations and temperatures, the heterogeneity has distinctly increased and the surface appearance is bad.

EXAMPLE 3

Figure 3:
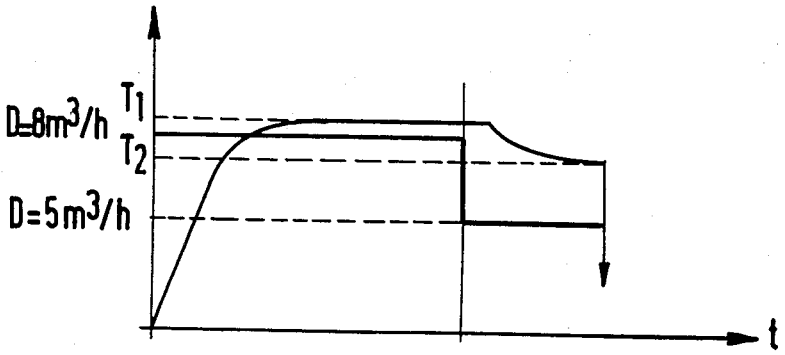
FIG. 3 is an illustration of the process according to the invention.

Under the same conditions as in Example 1 but with a flow rate of carrier gas of 8 $m^3/h$ during the carburizing phase ("conventional flow rate") and 5 $m^3/h$ during the diffusion phase (FIG. 3), the following results are obtained:

carburized thickness at 550 VH1=0.95 to 1.05 mm,
light grey appearance,
no residual austenite observable.

The quality of the charge is excellent and higher than that of Example 1.

Generally, Example 3 shows that is is possible to obtain a treatment of excellent quality (equivalent to or higher than that of Example 1) while minimizing the total gas consumption.

In the three foregoing examples, the atmosphere injected in the course of the carburizing phase comprised 80% methanol and 20% nitrogen, while the atmosphere injected in the course of the diffusion phase comprised about 30% methanol and 70% nitrogen, while the carbon potentials of these atmospheres were maintained within limits for the carburization and diffusion phases which are usual but identical in the three examples.

It will be understood that there may be substituted for the methanol any well-known bodies (in particular the alcohols) which are capable of producing at the usual carburization and diffusion temperatures carbon monoxide and hydrogen.

Also, in the known manner, there may be added to said atmospheres ammonia for effecting nitro-carburizing treatments.

What is claimed is:

1. In a carburization-diffusion process in a batch furnace having a door, the process comprising preheating said furnace to a carburizing temperature; opening the door of said furnace; introducing a workpiece into said furnace; closing the door of said furnace; injecting a carburization atmosphere at a flow rate of $D_1$ comprised of a mixture of between 10% to 85% nitrogen and the balance methanol; subjecting the workpiece to a first carburization phase, in the course of which the rate of transfer of the carbon from the atmosphere of the furnace to the surface of the workpiece is preponderant relative to the rate of diffusion of the carbon from the surface of the workpiece to the interior of the workpiece; injecting a diffusion atmosphere at a flow rate $D_2$ comprised of a mixture of between 10% and 85% nitrogen and the balance methanol different from the mixture comprising the carburization atmosphere; subjecting the workpiece to a second diffusion phase, in the course of which said rate of diffusion becomes preponderant relative to said rate of transfer; maintaining a temperature of between 850° C. and 1050° C. during said carburization and diffusion phases; and the flow rates $D_1$ and $D_2$ being in a relationship such that:

$$1.5D_2 \leqq D_1 \leqq 2D_2$$

where said flow rate $D_2$ is at least equal to the minimum safety flow rate of said furnace.

2. A carburization-diffusion process in a batch furnace according to claim 1, wherein said carburization atmosphere is injected into said furnace during the time between said opening and said closing of said door to said furnace at a flow rate equal to $D_1$.

3. A carburization-diffusion process in a batch furnace according to claim 1, wherein said carburization atmosphere is injected into said furnace during the time between said opening and said closing of said door to said furnace at a flow rate equal to $D_2$.

4. A carburization-diffusion process in a batch furnace according to claim 1, wherein said carburization atmosphere is injected into said furnace during the time between said opening and said closing of said door to said furnace at a flow rate $D_3$ which is greater than the flow rate $D_1$.

5. A carburization-diffusion process in a batch furnace according to claim 4, wherein said carburization phase occurs at a temperature $T_1$ and the flow rate $D_3$ of carburizing atmosphere injected into said furnace remains greater than the flow rate $D_1$ of the carburizing atmosphere during the carburizing phase until said furnace has returned to the temperature $T_1$ after said opening and closing of said furnace doors.

6. A carburization-diffusion process in a batch furnace according to claim 4, wherein the flow rates $D_1$ and $D_3$ are related by the relation: $1.2 \times D_1 \leqq D_3 \leqq 2 \times D_1$.

7. The process of claim 1, wherein the temperature of said diffusion phase is less than the temperature of said carburization phase.

8. The process of claim 1, wherein the workpiece is cooled prior to removal from said furnace.

9. The process of claim 1, further comprising the step of injecting a hydrocarbon in the carburization and diffusion phases to control the carbon potential of said carburization and diffusion atmospheres.

* * * * *